US006158846A

United States Patent [19]

Kawamura

[11] Patent Number: 6,158,846

[45] Date of Patent: Dec. 12, 2000

[54] FORMING REFILL FOR MONOLITHIC INKJET PRINTHEAD

[75] Inventor: Naoto Kawamura, Corvallis, Oreg.

[73] Assignee: Hewlett-Packard Co., Palo Alto, Calif.

[21] Appl. No.: 09/432,432

[22] Filed: Nov. 2, 1999

Related U.S. Application Data

[62] Division of application No. 08/907,535, Aug. 8, 1997, Pat. No. 6,019,907.

[51] Int. Cl.[7] ..... B41J 2/05

[52] U.S. Cl. ..... 347/65

[58] Field of Search ..... 347/63, 65

[56] References Cited

U.S. PATENT DOCUMENTS

| | | | |
|---|---|---|---|
| 4,455,192 | 6/1984 | Tamai | 216/27 |
| 5,159,353 | 10/1992 | Fasen et al. | 347/59 |
| 5,160,577 | 3/1992 | Deshpande | 216/27 |
| 5,194,877 | 3/1993 | Lam et al. | 347/63 |
| 5,305,015 | 4/1994 | Schantz et al. | 347/47 |
| 5,308,442 | 5/1994 | Taub et al. | 216/27 |
| 5,469,201 | 11/1995 | Erickson et al. | 347/85 |
| 5,502,471 | 3/1996 | Obermeier et al. | 347/65 |
| 6,003,977 | 12/1999 | Weber et al. | 347/63 |

FOREIGN PATENT DOCUMENTS

| | | | |
|---|---|---|---|
| 0244214A1 | 11/1987 | European Pat. Off. | B41J 3/04 |
| 244214 | 11/1987 | European Pat. Off. | B41J 3/04 |
| 0498293 | 8/1992 | European Pat. Off. | B41J 2/155 |
| 0771658A2 | 5/1997 | European Pat. Off. | B41J 2/16 |
| 59-109371 | 6/1984 | Japan | B41J 3/04 |

*Primary Examiner*—John Barlow
*Assistant Examiner*—Juanita Stephens

[57] ABSTRACT

A refill channel for multiple rows of nozzles is formed in a silicon die by thinning the die in the vicinity of the rows, then etching respective trenches within the thinned portion of the die. Monolithic architectures including such trenches are achieved for existing inkjet nozzle geometries having close row spacing.

4 Claims, 5 Drawing Sheets

FORMING REFILL FOR MONOLITHIC INKJET PRINTHEAD

This is a divisional of application Ser. No. 08/907,535 filed on Aug. 8, 1997, now U.S. Pat. No. 6,019,907.

BACKGROUND OF THE INVENTION

This invention relates generally to a method for fabricating monolithic inkjet nozzles for an inkjet printhead, and more particularly to fabricating a refill channel for serving multiple rows of inkjet nozzles.

A thermal inkjet printhead is part of an inkjet pen. The inkjet pen typically includes a reservoir for storing ink, a casing and the inkjet printhead. The printhead includes a plurality of nozzles for ejecting ink. A nozzle operates by rapidly heating a small volume of ink in a nozzle chamber. The heating causes the ink to vaporize and be ejected through an orifice onto a print medium, such as a sheet of paper. Properly sequenced ejection of ink from number nozzles arranged in a pattern causes characters or other images to be printed on the paper as the printhead moves relative to the paper.

The inkjet printhead includes one or more refill channels for carrying ink from the reservoir into respective nozzle chambers. Conventionally a nozzle chamber is defined by a barrier layer applied to a substrate. The refill channels are formed in the substrate. Feed channels and nozzle chambers are formed in the barrier layer. A respective feed channel serves to carry ink from the refill channel to a corresponding nozzle chamber. A firing resistor is situated at the base of the nozzle chamber. When activated, the resistor serves to heat the ink within the nozzle chamber causing a vapor bubble to form and eject the ink. For thin film resistor printheads, resistors are built up by applying various passivation, insulation, resistive and conductive layers on a silicon die. The die and thin film layers form a substrate.

An orifice plate is attached to the substrate. Nozzle openings are formed in the orifice plate in alignment with the nozzle chambers and firing resistors. The geometry of the orifice openings affects the size, trajectory and speed of ink drop ejection. Orifice plates often are formed of nickel and fabricated by lithographic electroforming processes. A shortcoming of these orifice plates are a tendency to delaminate during use. Delamination begins with the formation of small gaps between the plate and the substrate, often caused by (i) differences in thermal coefficients of expansion, and (ii) chemically-aggressive inks. Another difficulty is in achieving an alignment between the firing resistors and the orifice plate openings.

Refill channels in the substrate conventionally are formed by sandblasting. A disadvantage of sandblasting is the time and expense to drill channels one at a time. Another shortcoming is that such method results in sand and debris in the facility—a potential source of contaminants.

A monolithic approach to forming inkjet nozzles is described in copending U.S. patent application Ser. No. 08/597,746 filed Feb. 7, 1996 for "Solid State Ink Jet Print Head and Method of Manufacture." The process includes photoimaging techniques similar to those used in semiconductor device manufacturing. An embodiment of the invention herein is directed to a method for forming a refill channel in the silicon die of a monolithic printhead. This is particularly significant for manufacturing pens according to existing geometries requirements. Existing inkjet pens have specific nozzle spacings and row alignments (i.e., geometries). Printer models for such pens include print controllers programmed to time inkjet nozzle firing patterns based upon such geometries. Proper timing is needed for proper placement and formation of characters and markings on a media sheet. Replacement pens for such inkjet printers often are required to conform to such geometry so that the timing implemented by the controller for the replacement pen still works for proper placement and formation of characters and markings on a media sheet.

SUMMARY OF THE INVENTION

According to the invention, a refill channel for multiple rows of nozzles is formed in a silicon die by thinning the die in the vicinity of the rows, then etching respective trenches within the thinned portion of the die.

An exemplary printhead includes two rows of nozzles per color with a respective ink refill slot down the center of the two rows per color. The problem addressed by this invention is how to form an ink refill slot between the two rows given a geometry requiring a prescribed closeness of the rows. Using a conventional approach to forming the slot in a die of conventional thickness results in a thin layer bridge along a portion of the die between the nozzle rows for the length of the rows. It is known from experimentation that such thin layer bridges lose their robustness and are more prone to damage and breakage. Accordingly, an alternative approach for forming the refill slot is needed.

It also is known that when forming a trench in the (100) plane of a silicon die, the walls form at an angle (e.g., in effect an inverted pyramid geometry defines the shape of the trench). The term (100) refers to the (100) plane of the crystalline lattice of the silicon die. For conventional nozzle row spacing (e.g., approximately 700 microns) on a standard 6 inch wafer or a wafer thicker than 250 microns, the angled walls would overlap precluding the formation of isolated trenches. Conceivably, the trench could be formed in a <110> wafer to achieve vertical walls and geometries. However, the field effect transistors (FETs) on a <100> wafer are undesirably slower than FETs on a <100> wafer. Accordingly, use of the <100> wafer is desirable, and an alternative method is needed for forming an ink refill slot in the (100) plane.

According to one aspect of the invention, a mask is applied to the die surface at a surface opposite the surface where the nozzles are to be situated. The die then is thinned at the unmasked area leaving a first trench to a first depth in the die on the side of the die opposite the side where nozzles are to be situated. The first trench has angled side walls for an embodiment where it is etched in the (100) plane.

According to another aspect of the invention, a second mask then is applied along the walls of the first trench. Photoresist also is applied. Windows in the photoresist then are formed—one aligned with each row of nozzles. The mask then is etched in the windows revealing two respective portions of the wall s of the first trench. Two trenches then are etched through the windows to form, respectively, a second trench and a third trench within the first trench. The second trench and third trench are formed in the (100) plane in a preferred embodiment, and thus have the inverted pyramid geometry. Respective openings formed in the floors (or ceilings) of the respective second and third trenches couple the trenches to respective nozzle chamber locations. Such openings are the feed channels for the respective nozzles. Respective nozzles from one row of nozzles are coupled to one of the second trench or third trench by corresponding openings/feed channels. Respective nozzles from the other row of nozzles are coupled to the other of the second trench and third trench by corresponding openings/feed channels.

One advantage of the invention is that the existing inkjet printhead nozzle geometries are achieved for a monolithic inkjet architecture, even where row spacing is small. A benefit is that inkjet pens using the monolithic architecture can serve as replacement pens for the printers programmed to time nozzle firings based upon such existing geometries. Another advantage is that the monolithic architecture enables an increased useful life of the pen and avoids previous sources of failure and error. These and other aspects and advantages of the invention will be better understood by reference to the following detailed description taken in conjunction with the accompanying drawings.

DESCRIPTION OF SPECIFIC EMBODIMENTS

Figure 1:
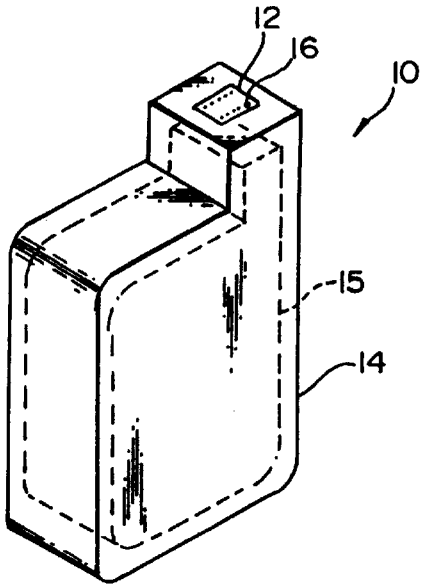
FIG. 1 is a perspective view of an inkjet pen having a printhead formed according to an embodiment of this invention.
Figure 2:
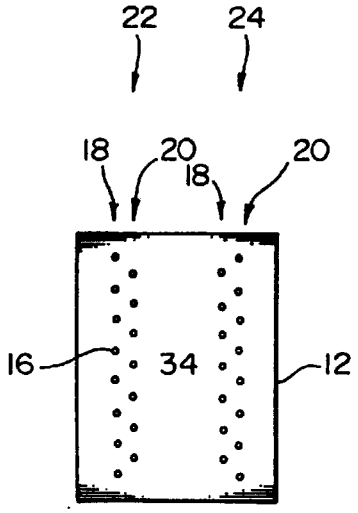
FIG. 2 is a diagram of a nozzle layout for an embodiment of the printhead of FIG. 1.

FIG. 1 shows a thermal inkjet pen 10 according to an embodiment of this invention. The pen 10 includes a printhead 12, a case 14 and an internal reservoir 15. As shown in FIG. 2 the printhead 12 includes multiple rows of nozzles 16. In the embodiment shown two rows 18, 20 are staggered to form one set of rows 22, while another two rows 18,20 are staggered to form another set of rows 24. The reservoir 15 is in physical communication with the nozzles 16 enabling ink to flow from the reservoir 15 into the nozzles 16. A print controller (not shown) controls firing of the nozzles 16 to eject ink onto a print media (not shown).

Figure 3:
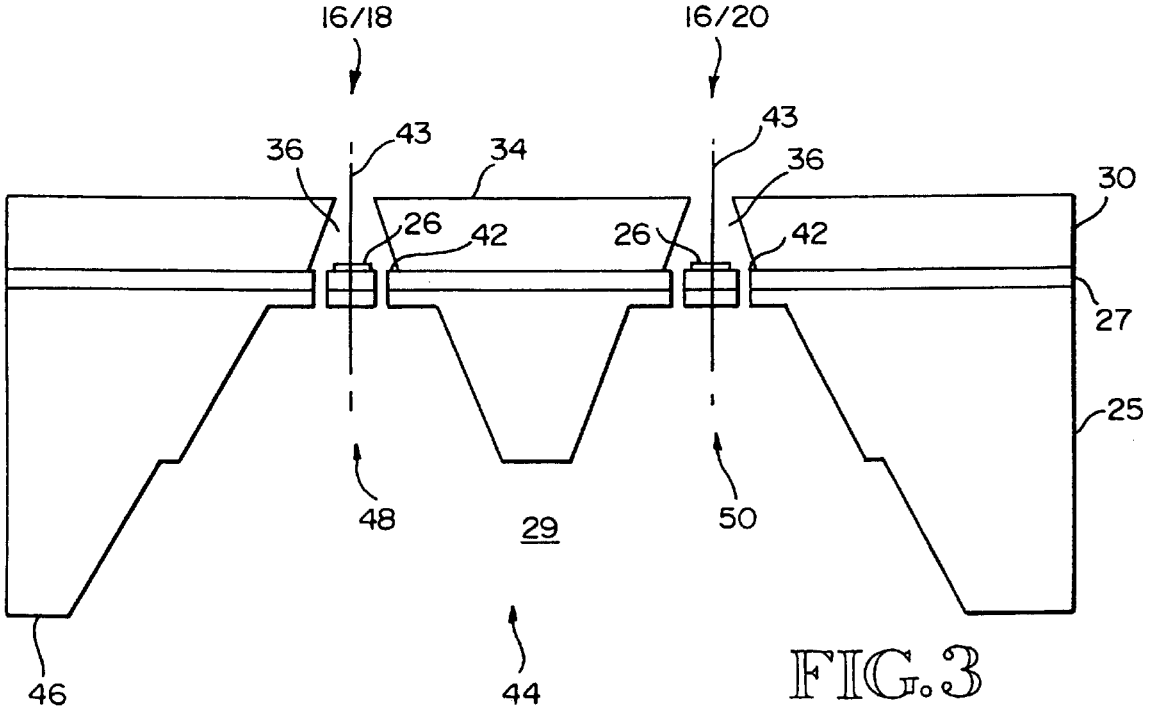
FIG. 3 is a sectional side view of a portion of the printhead of FIG. 1 showing two nozzles from respective rows of nozzles.

FIG. 3 shows a portion of the printhead 12, including a nozzle 16 from each row 18, 20 of one set of rows 22/24. The printhead 12 includes a silicon die 25, a thin film structure 27, and an orifice layer 30. The silicon die 25 provides rigidity and in effect serves as a chassis for other portions of the printhead 12. An ink refill channel 29 is formed in the die 25. The thin film structure 27 is formed on the die 25, and includes various passivation, insulation and conductive layers. A firing resistor 26 and conductive traces 28 (see FIG. 4) are formed in the thin film structure 27 for each nozzle 16. The orifice layer 30 is formed on the thin film structure 27 opposite the die 25. The orifice layer 30 has an exterior surface 34 which during operation faces a media sheet on which ink is to be printed. Nozzle chambers 36 and nozzle openings 38 are formed in the orifice layer 30.

Each nozzle 16 includes a firing resistor 26, a nozzle chamber 36, a nozzle opening 38, and one or more feed channels 40. A center point of the firing resistor 26 defines a normal axis 43 about which components of the nozzle 16 are aligned. Specifically it is preferred that the firing resistor 26 be centered within the nozzle chamber 36 and be aligned with the nozzle opening 38. The nozzle chamber 36 in one embodiment is frustoconical in shape. One or more feed channels 40 or vias are formed in the thin film structure 27 and die 25 to couple the nozzle chamber 36 to the refill channel 29. The feed channels 40 are encircled by the nozzle chamber lower periphery 42 so that the ink flowing through a given feed channel 40 is exclusively for a corresponding nozzle chamber 36.

Figure 4:
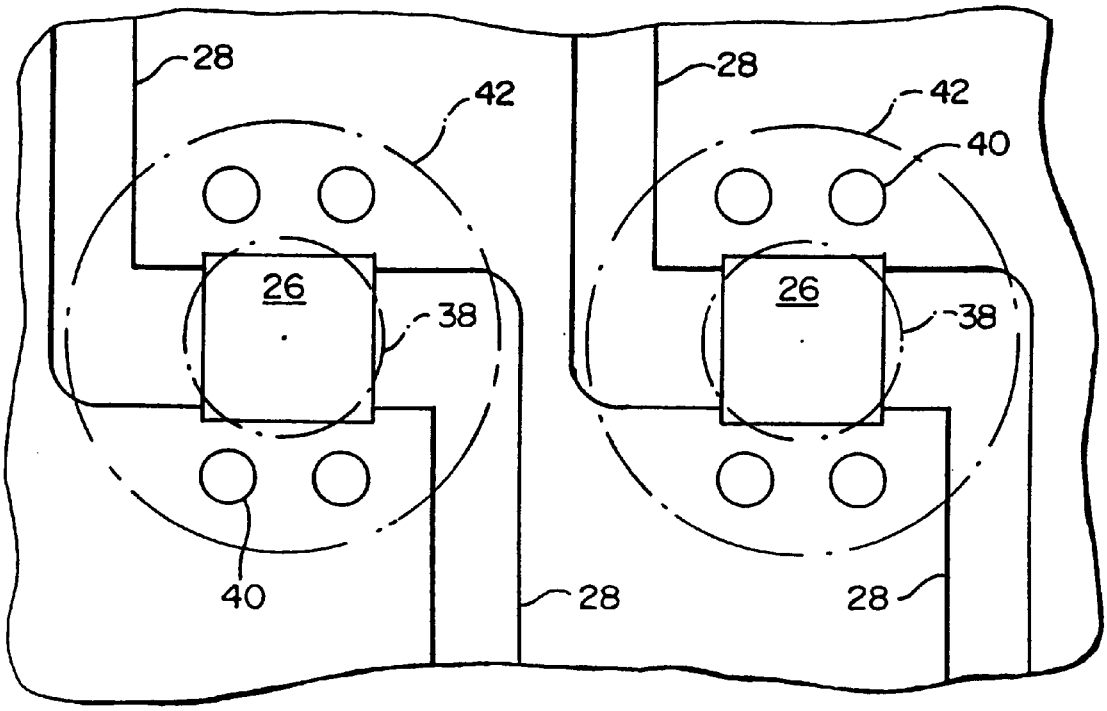
FIG. 4 is a sectional top view of the substrate portion of FIG. 3.

As shown in FIG. 4 the feed channels 40 are distributed about the firing resistor 26, permitting conductive traces 28 to provide electrical contact to opposed edges of the rectilinear resistor. The adjacent nozzle chambers 38 of a given row and between rows are spaced apart by a solid septum of the orifice layer 30. No ink flows directly from one chamber 36 to another chamber 36 through the orifice layer 30.

Referring again to FIG. 3, a refill channel 29 serves both rows 18, 20 of a given set of rows 22/24. In one embodiment there is an ink refill channel 29 serving the set of rows 22 and another refill channel 29 serving the other set of rows 24. A given ink refill channel 29 includes a wide opening 44, tapering inward along the cross-sectional distance from an undersurface 46 of the die 25 toward the thin film structure 27. Two slots are formed within the channel 29. A first slot 48 aligns with one row 18 of the rows 18, 20, while a second slot 50 aligns with the other row 20 of the rows 18, 20. Each slot 48, 50 tapers inward along a cross-sectional distance toward the thin film structure 27.

In an exemplary embodiment, the die 25 is a silicon die approximately 675 microns thick. Glass or a stable polymer are used in place of the silicon in alternative embodiments. The thin film structure 27 is formed by one or more passivation or insulation layers formed by silicon dioxide, silicon carbide, silicon nitride, tantalum, poly silicon glass, or another suitable material. The thin film structure also includes a conductive layer for defining the firing resistor and for defining the conductive traces. The conductive layer is formed by tantalum, tantalum-aluminum or other metal or metal alloy. In an exemplary embodiment the thin film structure is approximately 3 microns thick. The orifice layer has a thickness of approximately 10 to 30 microns. The nozzle opening 38 has a diameter of approximately 10–30 microns. In an exemplary embodiment the firing resistor 26 is approximately square with a length on each side of approximately 10–30 microns. The base surface 42 of the nozzle chamber 36 supporting the firing resistor 26 has a diameter approximately twice the length of the resistor 26. In one embodiment a 54° etch defines the wall angles for the opening 44, the first slot 48 and second slot 50. Although exemplary dimensions and angles are given such dimensions and angles mary vary for alternative embodiments.

Method of Manufacture

Figure 5A:
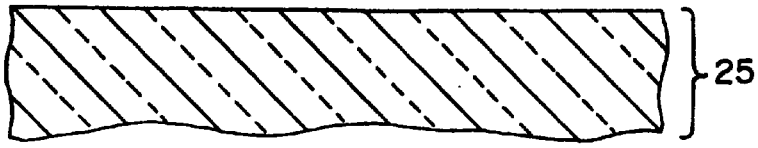
FIGS. 5*a–g* show the printhead formation at various stages of fabrication according to an embodiment of this invention.
Figure 5B:
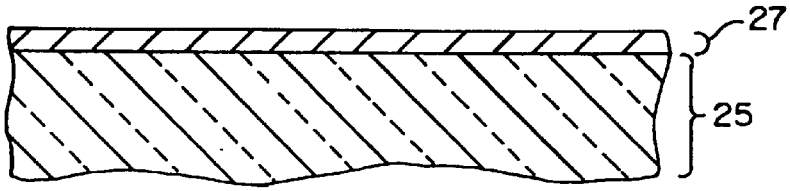
Figure 5C:
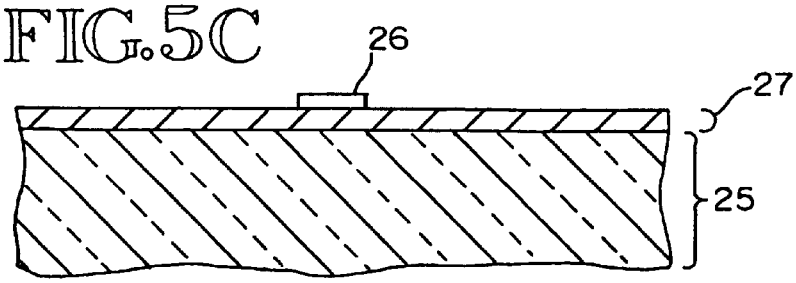
Figure 5D:
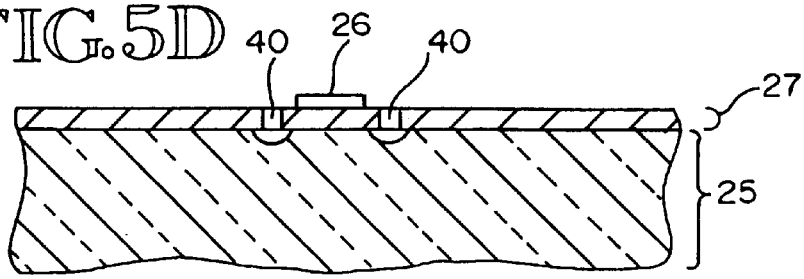
Figure 5E:
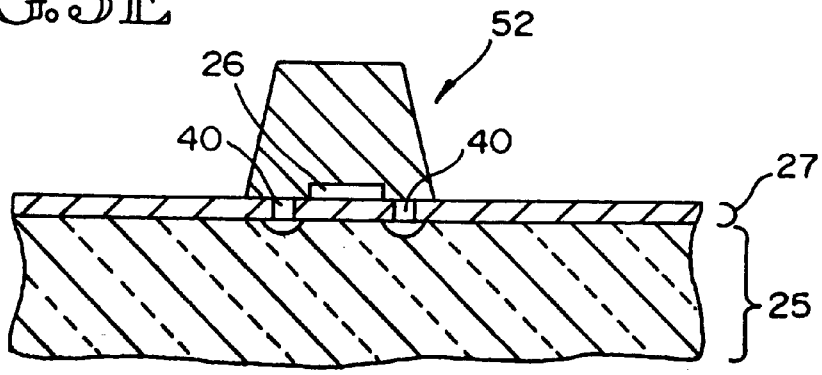

FIGS. 5*a–g* and 6*a–d* show a sequence of manufacture for the monolithic printhead embodiment of FIGS. 1–4. FIG. 5*a* shows a silicon die 25. A thin film structure 27 of one or more passivation, insulation and conductive layers is applied in FIG. 5*b*. The resistor 26 and conductive traces 28 (not shown) are applied in FIG. 5*c*. In FIG. 5*d* the feed channels 40 are etched (e.g., an isotropic process). Alternatively, the feed channels 40 are laser drilled or formed by another suitable fabrication method.

Figure 5F:
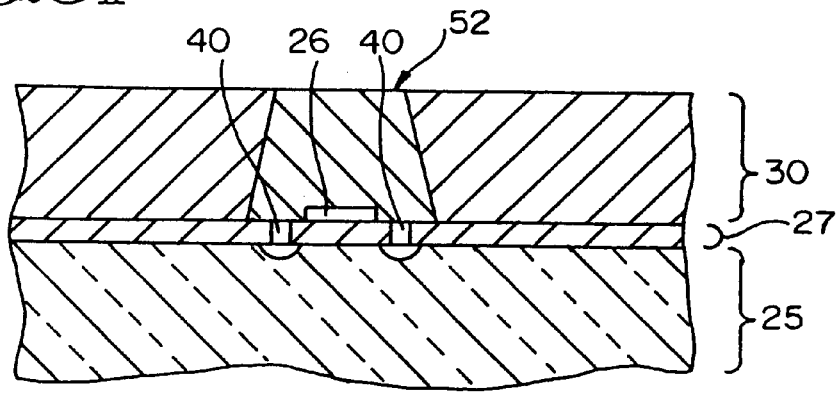
Figure 5G:
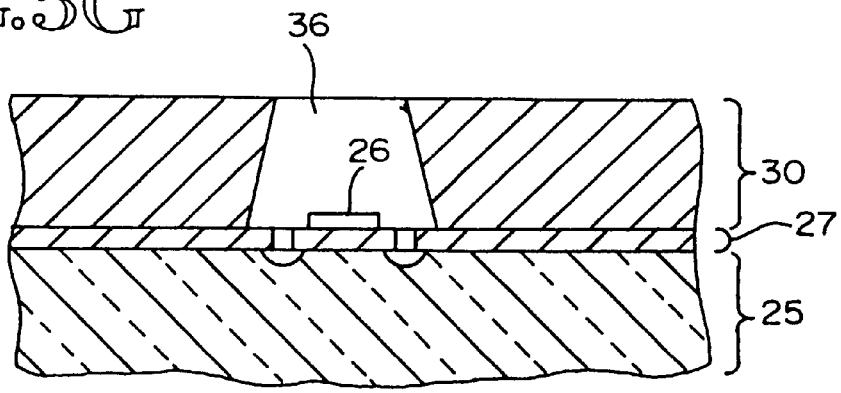

In one embodiment (see FIG. 5*e*) a frustoconical mandrel 52 is formed over each resistor 26 in the shape of the desired firing chamber. In FIG. 5*f* the orifice layer 30 is applied to the thin film structure 27 to a thickness flush with the mandrel 52. In one embodiment the orifice layer is applied by an electroplating process, in which the substrate is dipped into an electroplating tank. Material (e.g., nickel) forms on the thin film structure around the mandrel 52. In FIG. 5*g* the mandrel material is etched or dissolved from the orifice layer, leaving the remaining nozzle chamber 36.

Figure 6A:
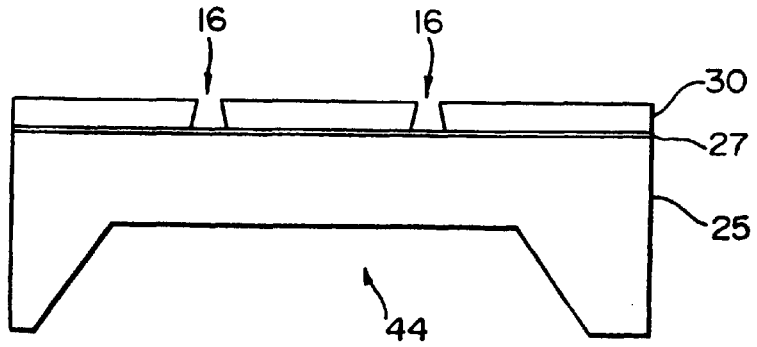
FIGS. 6*a–d* show the formation of the ink refill channel for the printhead of FIGS. 5*a–g*.
Figure 6B:
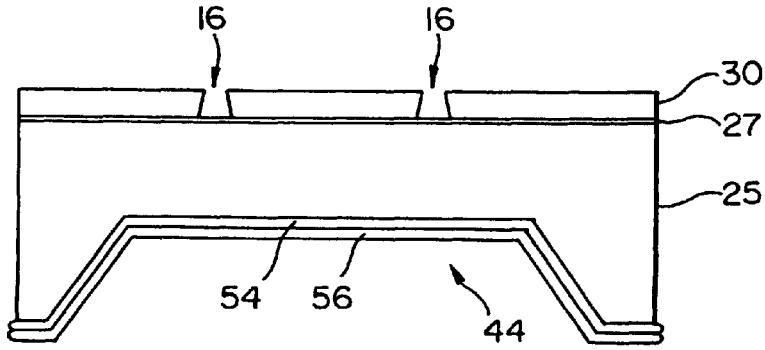
Figure 6C:
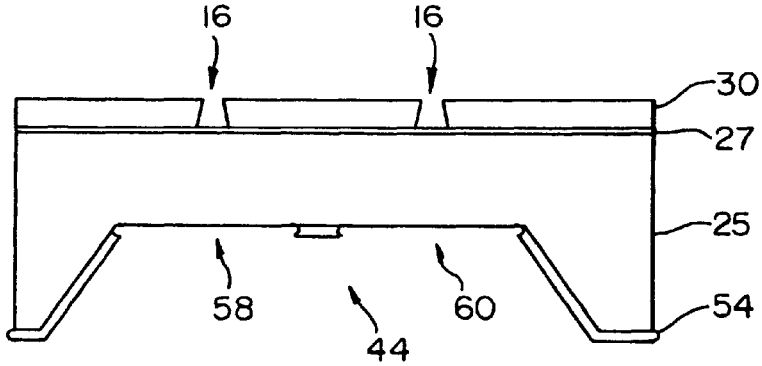

FIGS. 6*a–d* show the steps for fabricating the ink refill channel 29 for a given set 22/24 of rows 18,20. After a hard mask and photoresist layer are applied to the die 25, and a window is formed in the hard mask, a first trench 44 is etched in the die 25 at the surface opposite the thin film structure 27, as shown in FIG. 6*a*. Next, a hard mask 54 and photoresist layer 56 are applied to the die along at least the walls of the first trench 44, as shown in FIG. 6*b*. Next, respective portions of the photoresist layer 56 are exposed to define a first window 58 and a second window 60. The hard mask then is etched in the windows 58, 60. With the windows formed the photoresist is removed. FIG. 6*c* shows the printhead 12 with the windows 58, 60 formed. The remaining portion of the first trench 44 still is covered with the hard mask 54. In various embodiments the hard mask is formed by a metal, nitride, oxide, carbide or other hard mask. Alternatively, the hard mask is formed by a photoimageable epoxy. For the photoimageable epoxy embodiment, a separate photoresist layer is not needed. Windows in the epoxy are definable photoimagably. The windows 58, 60 are formed in the epoxy by photoimaging techniques. The epoxy, however, resists the etching chemistry, and thus stays in place around the windows during the subsequent etching.

Figure 6D:
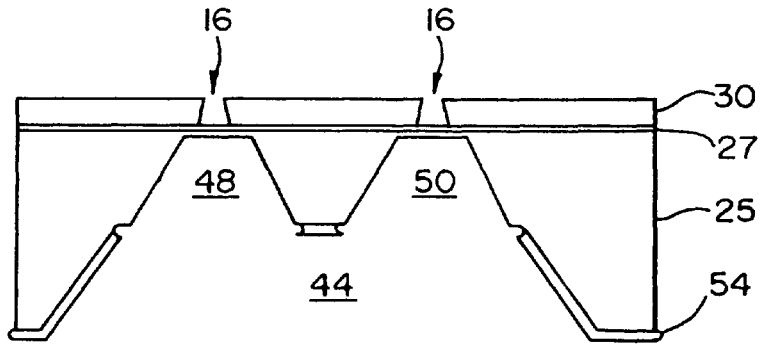

Next a second trench 48 and a third trench 50 are etched as shown in FIG. 6*d*. The second trench 48 is etched through the first window 58 all the way through the die 25 or to a prescribed depth. The prescribed depth leaves a thin bridge of the silicon die 25 adjacent to the thin film structure 27 underlying the nozzle chamber 36. In addition such second trench 48 exposes the feed channels 40 previously formed (see FIG. 5*d*). The third trench 50 also is etched through the second window 60 all the way through the die 25 or to the prescribed depth. Such third trench 50 exposes the feed channels 40 previously formed (see FIG. 5*d*). The remainder of the hard mask 54 then are removed leaving the fabricated printhead shown in FIGS. 2–4.

According to a preferred embodiment the silicon die is etched at the <100> direction of the die 25. As a result the trenches 44, 48, 50 include angled sidewalls. In effect an inverted pyramid geometry defines the shape of the trenches 48, 50. The term <100> refers to the <100> direction of the crystalline lattice of the silicon die.

Meritorious and Advantageous Effects

One advantage of the invention is that the existing inkjet printhead nozzle geometries are maintained for a monolithic inkjet architecture. A benefit is that inkjet pens using the monolithic architecture can serve as replacement pens for the printers basing print operations on such existing geometries. Another advantage is that the monolithic architecture enables an increased useful life of the pen and avoids previous sources of failure and error.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. An inkjet pen comprising:

a pen body having an internal reservoir region; and a monolithic printhead comprising a die, a thin film structure, and an orifice layer, the thin film structure formed at one side of the die, the orifice layer formed at a side of the thin film structure opposite the die;

wherein respective nozzles are formed in the printhead, each nozzle including a nozzle chamber and a firing resistor, the orifice layer having openings, each opening aligned with a corresponding nozzle chamber, wherein the respective nozzles are formed in multiple rows, and wherein a refill slot is formed in the die for adjacent rows of the multiple rows, the refill slot formed in the die at a side opposite the thin film structure by first thinning the die at said opposite side, then forming one trench in the thinned portion for one of the adjacent rows and another trench in the thinned portion for another of the adjacent rows, and wherein respective feed channels are formed for each nozzle of the adjacent rows, each feed channel coupling a corresponding nozzle chamber to one of either said one trench or said another trench.

2. An inkjet printing apparatus, comprising:

a printhead die having a front surface and an opposing back surface, the front surface having both a first plurality of nozzle chambers formed thereon and arranged along a first row and a second plurality of nozzle chambers formed thereon and arranged along a second row, the opposing back surface having a first slot substantially aligned with the first row and having a second slot substantially aligned with the second row;

the printhead die having a plurality of feed channels connecting the first plurality of nozzle chambers to the first slot and connecting the second plurality of nozzle chambers to the second slot, wherein each one of the first plurality of nozzle chambers is connected to the first slot by at least two feed slots of the plurality of feed slots, and wherein each one of the second plurality of nozzle chambers is connected to the second slot by at least two feed slots of the plurality of feed slots.

3. The inkjet printing apparatus of claim 2, wherein the opposing back surface has a wide opening encompassing both the first slot and the second slot.

4. The inkjet printing apparatus of claim 2, further comprising a print controller that controls firing of ink from the first plurality of nozzle chambers and the second plurality of nozzle chambers.

* * * * *